United States Patent [19]

Boulter

[11] 4,230,236

[45] Oct. 28, 1980

[54] TABLET DISPENSER

[75] Inventor: Clive Boulter, West Bridgford, England

[73] Assignee: The Boots Company Limited, Nottingham, England

[21] Appl. No.: 50,874

[22] Filed: Jun. 21, 1979

[51] Int. Cl.[3] ..... B65G 59/06

[52] U.S. Cl. ..... 221/190; 221/281; 221/200; 221/264

[58] Field of Search ..... 221/289–293, 221/296, 298, 311, 312, 281, 282, 200, 190, 187, 263, 264

[56] References Cited

U.S. PATENT DOCUMENTS

| | | | |
|---|---|---|---|
| 2,548,310 | 4/1951 | Jennings | 221/187 |
| 3,191,803 | 6/1965 | Hamilton | 221/264 X |
| 3,332,576 | 7/1967 | Hamilton | 221/264 X |

FOREIGN PATENT DOCUMENTS

| | | | |
|---|---|---|---|
| 2013636 | 8/1979 | United Kingdom | 221/263 |

*Primary Examiner*—Allen N. Knowles
*Attorney, Agent, or Firm*—Gordon W. Hueschen

[57] ABSTRACT

This invention relates to a container for generally cylindrical tablets which can be used to repeatedly dispense the tablets in pre-determined quantities. The dispenser comprises an outer case and a slidably mounted inner part which together define a container, a dispensing gate, and a downward sloping channel connecting one or two ramps situated at the base of the container to the gate. The width of the channel is such as to allow a single column of tablets supported on their peripheries. The inner part is depressable from the exterior to cause relative movement between the gate and the channel from one position where the gate is in register with the channel to a second position where the gate is in register with a dispenser outlet. The relatively simple design of the dispenser enables it to be injection-moulded from plastic material.

8 Claims, 9 Drawing Figures

TABLET DISPENSER

This invention relates to containers and in particular, to containers suitable for dispensing tablets.

It is often useful in, for example, the dispensing of saccharin tablets and medicines in tablet form to employ a container from which the tablets can be ejected in predetermined quantities, usually one at a time. Tablets are commonly provided in the form of short cylinders wherein the diameter of the cylinder is greater than its height. The end faces of the cylinder may be plane or concave but are generally convex i.e. domed. It will be appreciated that when such tablets are stored in a dispenser, unless special measures are taken to ensure that the tablets are retained in an orientated manner, e.g. in a single row, they will take up random orientations to one another. Tablets in such a random distribution are difficult to dispense without damage. For example, there is a tendency for them to become congested at the point of exit where they can be crushed if the design of the container is unsatisfactory.

The present invention provides a tablet dispenser for use in repeatedly dispensing a predetermined number of generally cylindrical tablets of uniform size randomly orientated in the dispenser, the dispenser comprising an outer case with a base and an inner part slidably mounted in the outer case for linear movement between a dispensing position and a non-dispensing position, the inner part being biased away from said base, the inner part and outer case together defining a container for the tablets, a dispensing gate for housing a predetermined number of tablets, a channel having a bottom sloping downwardly towards the gate, said channel having a portion open to the container and being defined between the inner part and the outer case, and at least one ramp surface at the bottom of the container leading to said portion of the channel so as to direct tablets into the channel supported on their peripheries in a single tablet width column, so that they roll down the channel towards the gate, the inner part having a portion depressable from the exterior of the dispenser against said bias to cause relative movement between the gate and channel, from one position wherein said gate is in register with the channel and another position wherein the gate is in register with a dispensing outlet located in the lower part of the dispenser.

In such a container the outer case or the slidable inner part may incorporate the ramp surface. Alternatively both outer case and inner part may bear ramps. The dimensions of the channel are such as to allow the alignment of a single column of tablets supported on their peripheries which means that the channel has a width a little greater than the maximum height of the tablet cylinder.

Two examples of containers according to the invention are illustrated in the accompanying drawings in which.

Figure 3:
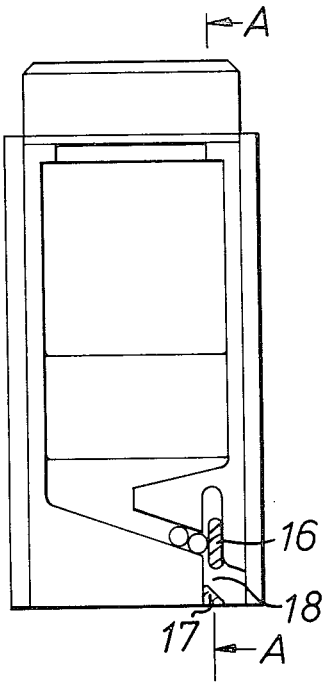
FIG. 3 is a section of FIG. 2 along the line B—B.
Figure 4:
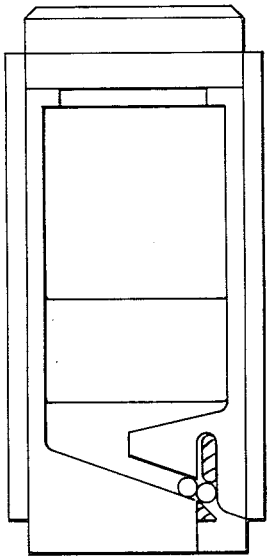
Figure 5:
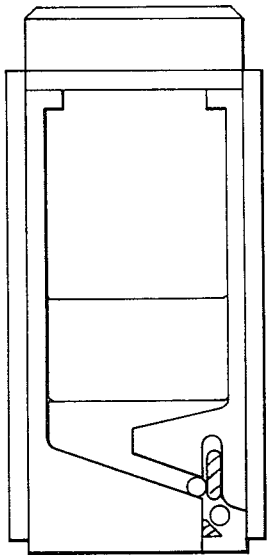

FIGS. 4 and 5 together with FIG. 3 illustrate the various stages involved in the dispensing of a tablet in the first embodiment.

Figure 6:
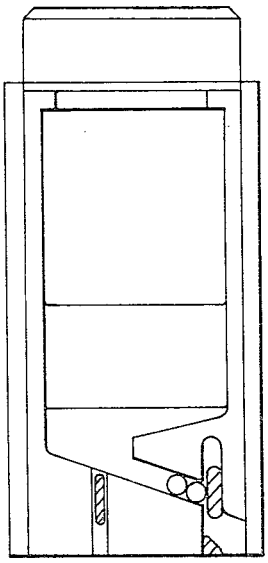

FIG. 6 is a sectional view of a modification of the first embodiment.

Figure 7:
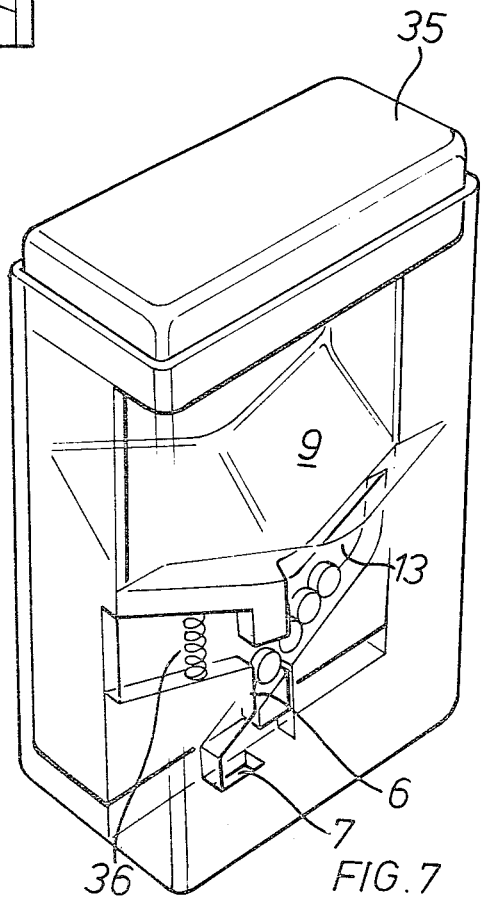

FIG. 7 is a perspective view of a second embodiment of the invention wherein the outer wall case is depicted as being transparent in order to show the configuration of the internal parts.

Figure 8:
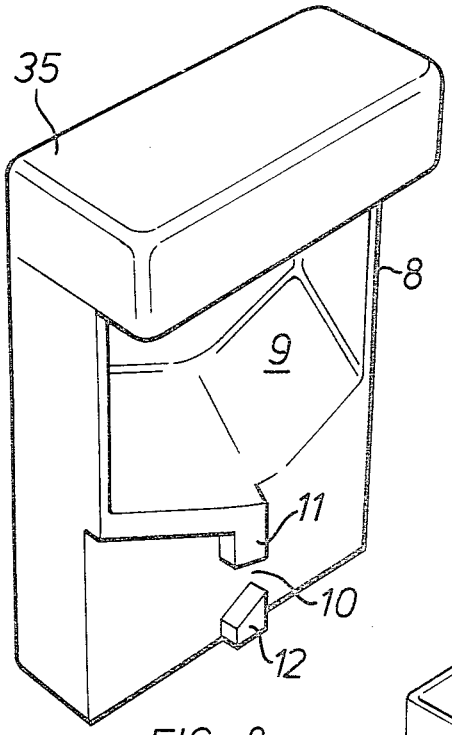
Figure 9:
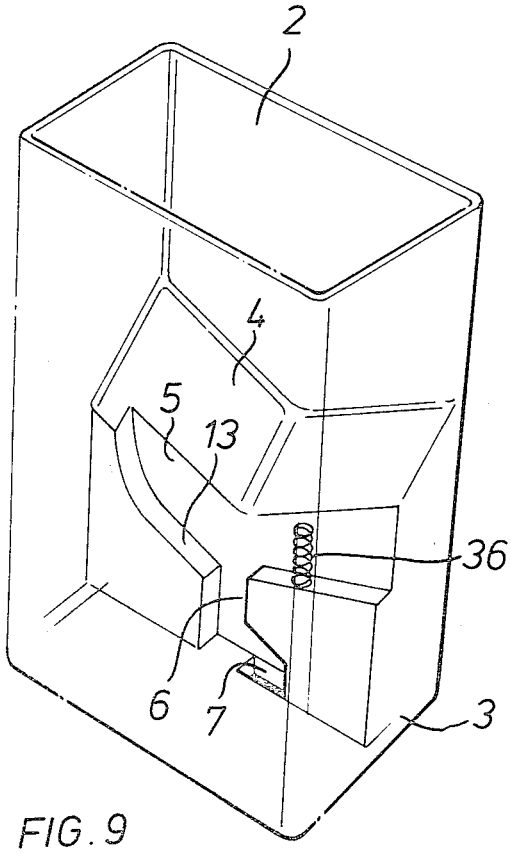

FIGS. 8 and 9 are perspective views of the inner part and outer case of the dispenser shown in FIG. 7.

Figure 1:
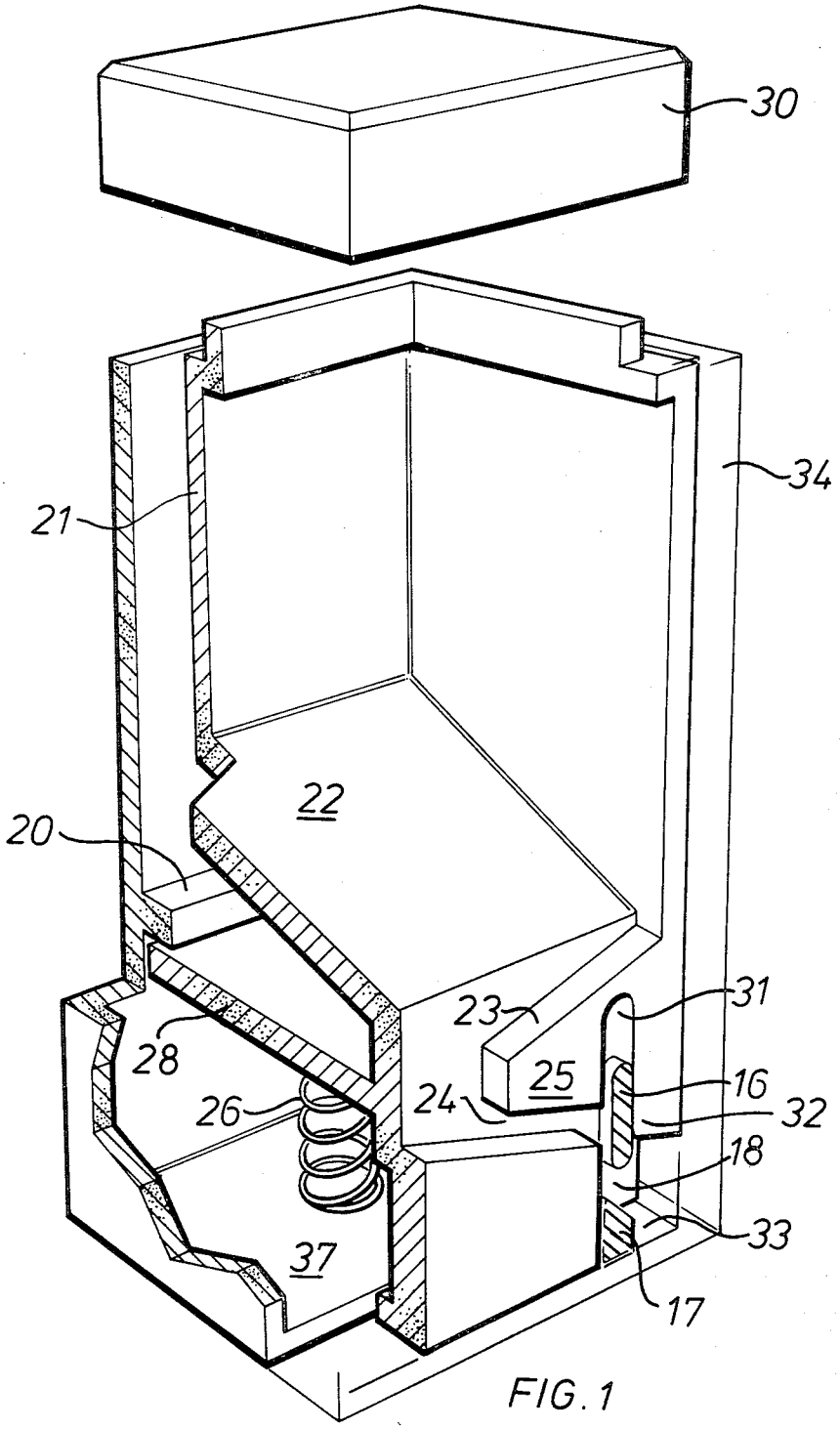
FIG. 1 is a perspective view of a first embodiment cut away to reveal the internal configuration.
Figure 2:
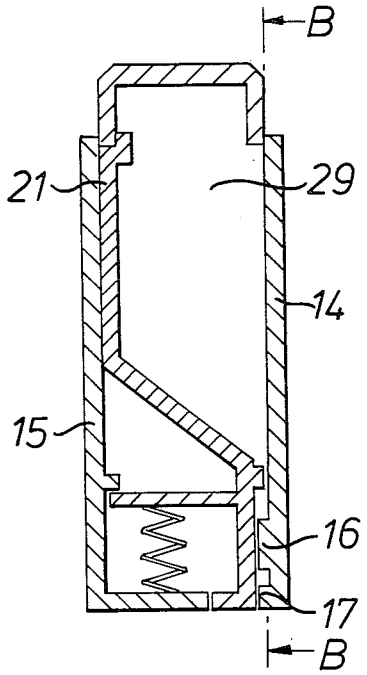
FIG. 2 is a section of FIG. 3 along the line A—A.

Referring to the drawings:

In the first embodiment of a container according to the invention shown in FIGS. 1 and 2 the container has an outer case (34) of rectangular cross-section formed from two parts, a front section (14) and a rear section (15) including a base (37). The front section (14) has integrally moulded upon it an upper projecting portion (16) and a lower projecting portion (17) which between them define a gate (18). The rear section (15) has a stop (2)) to define a resting position of the inner part (21).

The inner part (21) is provided with a ramp (22), below which is cut a downward sloping groove (23) leading to a channel (24) defined on its upper surface by an overhang (25). The dimensions of the inner part (21) are such that its fits slidably in the outer case (34).

When the assembled the outer case (34) is biased away from the base (37) by a spring (26) held in position by the base (37) and a plate (28) integrally moulded on the inner part (21) situated beneath the ramp (22) and abutting against the stop (20) to define the resting position.

When the chamber (29) is filled with tablets they fall to the base of the ramp (22). Any tablets aligned on their edge enter the downward sloping groove (23) and thence to the channel (24), where they are prevented from entering the gate (18) by the upper projection (16).

When the inner part (21) is depressed by means of pressure on the cap (300, the inner part (21) moves downwards until the end of the gate housing (31) abuts against the top of the upper projection (16). In this position the gate (18) is aligned with the channel (24) and a tablet can roll into the gate (18). Tablets are prevented from rolling through the gate by the gate barrier (32) integrally moulded on the inner part (21), which descends during the downward movement. The gate width is such that a predetermined number of tablets e.g. 1, can be accommodated.

On releasing the pressure to the cap (30), the spring (26) causes upward movement of the inner part (21) and the tablet in the gate (18) is isolated from the interior of the device. Since the upper surface of the lower projection (17) is downward sloping the tablet rolls out of the gate (18) and falls under the influence of gravity through the dispensing outlet (33).

The repeated movement of the inner part (21) ensures that the channel has a constant supply of tablets which are orientated by the ramp (22).

Thus in this embodiment of the invention the gate defining projections (16) and (17) are located on the front outer section, the channel moves downwards to align with the gate (18), and the tablet is dispensed during the upward movement of the inner part (21), whereas, in the following embodiment the gate defining projections (11) and (12) are located on the inner part, the gate (10) moves downwards to align with the dispersing outlet (7), and the tablet is dispensed during the downward movement of the inner part (8).

In the second embodiment depicted in FIGS. 7–9 the container has an outer case (1) of rectangular cross-section with an open top (2) closed by a cap (36) which abuts against an inner part (8) and a base (3). The outer case is provided with a ramp (4) on one of its inner surfaces. Part of the ramp is cut away to form a downward-sloping shoulder (5) and a stop (6) which projects over an orifice (7) in the base (3).

The dimensions of the slidable inner part (8) are such that it fits slidably in the outer case (1). It bears a curved ramp (9), one face of which is formed into a gate (10) defined by upper and lower projecting portions (11 and 12).

When assembled, the outer case (1) and inner part (8) are biased apart by a spring (36) contained within a cavity beneath the ramp (9). The two ramps (4 and 9) co-operate to form a funnel which directs tablets in the container into a channel (13) formed between the shoulder (5) and face of the ramp (9). Tablets roll down the channel (13) which is shaped so that tablets are aligned in a single row (shown in FIG. 7). One tablet enters the gate (10) and is held between upper and lower projecting portions (11 and 12).

When the cap (36) is pressed, the downward movement is transferred to the inner part (8) which moves downward until it is restrained by the base of the outer case (1), the movement being sufficient for the gate (10) to clear the stop, and the tablet held between portions (11 and 12) is thus allowed to fall freely through the orifice (7) in the base.

On releasing the pressure the inner part (8) returns to its original position exposing the gate (8) to another tablet.

The repeated movement of the inner part (8) ensures that the channel (13) is kept charged with tablets which are repeatedly tipped over the edges of the ramps (4 and 9). By lifting unaligned tablets on its return to the rest position, the ramp (9) relieves pressure on tablets in the channel (13) and so facilitates their rolling into the gate (10).

When the inner part (8) is pressed downwards it is convenient to stop its movement by abutment against the base of the outer case (1), but alternative stop means can be used provided that at the limit of downward movement the two ramps (4 and 9) come together to form channel (13) and exit of tablets is allowed from gate (10).

An additional component may be incorporated into a dispenser according to the invention in order to assist with agitation of the tablets. Such an adaption of the first embodiment is illustrated in FIG. 6. The component takes the form of a finger like projection moulded on to the front outer case (14). During the dispensing operation this projection is introduced into the channel (24) and serves to disturb those tablets at the base of the ramp (22).

The outer case and inner part can be designed to be free of re-entrant angles and under-draws so that they can be conveniently injection moulded employing a suitable platic material such as for example polypropylene, a styrene polymer, or a suitable combination of materials. If the slidable inner part is made of suitable material, for example polypropylene, the spring can be integrally moulded with it. Alternatively a metal coil or C-spring can be employed.

It will be clear that variations can be made to the structure described above without altering the principle of its action. For example the shape and dimensions of the ramps (4, 9, 22) can be such as to allow exit of tablets from the centre of the base (3, 37). The shape of the outer case (1, 34) can also be circular in cross-section or of generally rectangular shape with curved opposing faces, but in both cases the radius of curvature of the case must be greater than that of the faces of the tablet or congestion will tend to occur in the channel.

If desired the container can be readily adapted to dispense more than one tablet at a time, by enlarging the gate (10, 18) so that it holds two, three or more tablets at a time.

I claim:

1. A tablet dispenser for use in repeatedly dispensing a predetermined number of generally cylindrical tablets of uniform size randomly orientated in the dispenser, the dispenser comprising an outer case with a base and an inner part slidably mounted in the outer case for linear movement between a dispensing position and a non-dispensing position, the inner part being biased away from said base towards a resting position, the inner part and outer case together defining a container for the tablets, a dispensing gate for housing a predetermined number of tablets, a channel having a bottom sloping downwardly towards the gate, said channel having a portion open to the container and being defined between the inner part and the outer case, and at least one ramp surface at the bottom of the container leading to said portion of the channel so as to direct tablets into the channel supported on their peripheries in a single tablet width column, so that they roll down the channel towards the gate, the inner part being operated against said bias to cause relative movement between the gate and channel, from one position wherein said gate is in register with the channel and another position wherein the gate is in register with a dispensing outlet located in the lower part of the dispenser.

2. A dispenser according to claim 1 wherein dispensing is effected by pressure upon a cap covering the container which abuts against the slidable inner part.

3. A dispenser according to claim 1 wherein both the outer case and slidable inner part are provided with ramps to assist movement of tablets into the channel.

4. A dispenser according to claim 1 wherein the gate is in register with the channel in the resting position.

5. A dispenser according to claim 1 wherein the gate is in register with the dispensing outlet in the resting position.

6. A dispenser according to claim 1 wherein the resting position is defined by abutment between a portion of the inner part and a projection on the outer case.

7. A dispenser according to claim 1 wherein the dimensions of the gate are such as to house one tablet.

8. A dispenser according to claim 1 wherein the dispensing outlet is located in the base of the outer case.

* * * * *

UNITED STATES PATENT AND TRADEMARK OFFICE

CERTIFICATE OF CORRECTION

PATENT NO. : 4,230,236

DATED : October 28, 1980

INVENTOR(S) : Clive Boulter

It is certified that error appears in the above-identified patent and that said Letters Patent are hereby corrected as shown below:

Col. 2, line 16; "(2))" should read -- (20) --
Col. 2, line 21; "its" should read -- it --
Col. 2, line 22; Delete "the" (first occurrence)
Col. 2, line 34; "(300," should read -- (30), --

Signed and Sealed this

*Twenty-fourth* Day of *February 1981*

[SEAL]

*Attest:*

RENE D. TEGTMEYER

*Attesting Officer*

*Acting Commissioner of Patents and Trademarks*